US012134804B2

(12) United States Patent
Ott et al.

(10) Patent No.: US 12,134,804 B2
(45) Date of Patent: Nov. 5, 2024

(54) THERMO-MECHANICAL PROCESSING OF HIGH-PERFORMANCE Al-RE ALLOYS

(71) Applicants: Iowa State University Research Foundation, Inc., Ames, IA (US); UT-Battelle, LLC, Oak Ridge, TN (US); University of Tennessee Research Foundation, Knoxville, TN (US); Fok Industries, Inc., Manitowoc, WI (US); Lawrence Livermore National Security, LLC, Livermore, CA (US)

(72) Inventors: Ryan T. Ott, Ames, IA (US); Orlando Rios, Oak Ridge, TN (US); Zachary C. Sims, Knoxville, TN (US); David Weiss, Manitowoc, WI (US); Michael G. Kesler, Oak Ridge, TN (US); Fanqiang Meng, Zhuhai (CN); Scott K. McCall, Livermore, CA (US); Hunter B. Henderson, Livermore, CA (US)

(73) Assignees: Iowa State University Research Foundation, Inc., Ames, IA (US); Lawrence Livermore, National Security, LLC, Livermore, CA (US)

( * ) Notice: Subject to any disclaimer, the term of this patent is extended or adjusted under 35 U.S.C. 154(b) by 0 days.

(21) Appl. No.: 17/803,369

(22) Filed: May 24, 2022

(65) Prior Publication Data

US 2022/0380868 A1 Dec. 1, 2022

Related U.S. Application Data

(60) Provisional application No. 63/258,847, filed on Jun. 1, 2021.

(51) Int. Cl.
*C22C 21/00* (2006.01)
*B21C 23/01* (2006.01)
(Continued)

(52) U.S. Cl.
CPC ..... *C22C 21/00* (2013.01); *B21C 23/01* (2013.01); *B21C 23/14* (2013.01); *B21C 29/003* (2013.01);
(Continued)

(58) Field of Classification Search
CPC ..... C22C 21/00; C22C 1/026; C22C 1/0416; B21C 23/14; B21C 23/01; B21C 29/003;
(Continued)

(56) References Cited

U.S. PATENT DOCUMENTS 9,963,770 B2 5/2018 Rios et al.
2018/0237893 A1* 8/2018 Rios ..... C22F 1/002

FOREIGN PATENT DOCUMENTS

CN 1003667822 A 3/2014
WO 0222002 B1 * 9/1992 ..... B22F 1/0085

OTHER PUBLICATIONS

Sims et al, "Cerium-Based, Intermetallic-Strengthened Aluminum Casting Alloy: High-Volume Co-product Development", The Minerals Metals & Materials Society, May 2016, 8 pages.
(Continued)

*Primary Examiner* — Adil A. Siddiqui

(57) ABSTRACT

Production of a bulk Al-RE alloy body (product) using cast billets/ingots (cooling rates <100 C/s) or rapidly solidified Al-RE particulates (cooling rates $10^2$-$10^{6}$° C./second) that have beneficial microstructural refinements that are further refined by subsequent consolidation to produce a consolidated bulk alloy product having excellent mechanical properties over a wide temperature range such as up to and above 230° C.

9 Claims, 4 Drawing Sheets

(51) Int. Cl.

| | |
|---|---|
| ***B21C 23/14*** | (2006.01) |
| ***B21C 29/00*** | (2006.01) |
| ***B21C 29/02*** | (2006.01) |
| ***B21C 31/00*** | (2006.01) |
| ***B22F 3/12*** | (2006.01) |
| ***B22F 3/20*** | (2006.01) |
| ***B22F 9/08*** | (2006.01) |
| ***C22C 1/02*** | (2006.01) |
| ***C22C 1/04*** | (2023.01) |
| ***C22F 1/04*** | (2006.01) |

(52) U.S. Cl.
CPC ..... *B21C 29/02* (2013.01); *B21C 31/00* (2013.01); *B22F 3/12* (2013.01); *C22C 1/026* (2013.01); *C22F 1/04* (2013.01); *B22F 3/20* (2013.01); *B22F 2009/0824* (2013.01); *C22C 1/0416* (2013.01)

(58) Field of Classification Search
CPC . B21C 29/02; B21C 31/00; C22F 1/04; B22F 3/20; B22F 2009/0824; B22F 3/12
See application file for complete search history.

(56) References Cited

OTHER PUBLICATIONS

Zener et al., Characterization Of Effects Of Plane-Front Solid Solution, Journal of Applied Physics, vol. 20, 1949, pp. 950-953.
U.S. Appl. No. 17/335,274, filed Jun. 1, 2022.

* cited by examiner

THERMO-MECHANICAL PROCESSING OF HIGH-PERFORMANCE Al-RE ALLOYS

STATEMENT REGARDING FEDERALLY SPONSORED RESEARCH

This invention was made with government support under contract nos. DE-AC02-07CH11358; DE-AC05-00OR22725; and DE-AC52-07NA27344 awarded by the Department of Energy. The Government has certain rights in the invention.

FIELD OF THE INVENTION

The present invention relates to aluminum-rare earth alloys and, more particularly, to production of a bulk Al-RE alloy product made using cast billets/ingots (cooling rates <100° C./second) or rapidly solidified Al-RE particulates (cooling rates $10^2$-$10^{6}$° C./second) that have beneficial microstructural refinements to produce a consolidated bulk alloy product having excellent mechanical properties over a wide temperature range such as from room temperature up to and above 230° C.

BACKGROUND OF THE INVENTION

Certain aluminum alloys that include rare earth metals, such as Ce, La, and mischmetal, are known and can be cast and optionally heat treated to exhibit excellent mechanical properties such as tensile strength and ductility at elevated temperatures as described in U.S. Pat. No. 9,963,770. These cast or cast/heat treated aluminum-rare earth alloys (hereafter Al-RE alloys) have a multi-phase microstructure that includes an intermetallic secondary phase (e.g. $Al_{11}X_3$ where X is the rare earth metal) in an aluminum-rich matrix. The intermetallic secondary phase is present in relatively high volume fraction in the form of a complex network of morphological phase features, such as lath features and/or rod features, in the aluminum-rich matrix in a manner that imparts excellent mechanical properties to the cast alloy. Since the intermetallic secondary phase features are thermally stable at elevated temperatures, the cast alloy exhibits excellent mechanical properties over a wide range of temperatures.

The present invention has as an object to provide bulk Al-RE alloy products made by certain thermo-mechanical processing steps of a solidified Al-RE alloy so as to have more refined microstructural features that provide excellent mechanical properties over a wide temperature range.

SUMMARY OF THE INVENTION

In accordance with one aspect of the present invention, the foregoing and other objects are achieved by a method that includes forming a bulk Al-RE alloy by:

a) solidifying a molten Al-RE alloy where RE=Ce, La, mischmetal, or any combination thereof, and b) thermo-mechanical processing the solidified Al-RE alloy in a manner that refines at least a portion of a microstructural feature of the solidified Al-RE alloy.

In practice of certain aspects of the present invention, the solidified Al-RE alloy comprises a cast billet, cast ingot or other monolithic (bulk) cast body made by introducing the molten alloy in a sand mold, permanent mold, die casting mold, or other mold, or by direct chill casting, and solidifying the alloy at a cooling rate <100° C./second. Thermo-mechanical processing is conducted to fragment and thus refine at least a portion of an intermetallic strengthening phase and/or refine grain size present in the solidified alloy microstructure.

In certain other aspects of the present invention, the solidified Al-RE alloy is made by:

a) rapid solidification processing of a molten Al-RE alloy, where RE is Ce, La, mishmetal, or any combination thereof, to achieve rapid cooling rates of the alloy of $10^2$-$10^{6}$° C./second, b) forming particulates during or after rapid solidification processing of the molten Al-RE alloy, wherein the particulates are characterized as having a particle microstructure including a strengthening intermetallic phase distributed in an aluminum-rich matrix, wherein the strengthening intermetallic phase is characterized by having a rapid solidification-refined intermetallic phase structure, and c) consolidating at least one of the particulates and a precursor body comprised of the particulates to form a bulk Al-RE alloy body wherein consolidating is conducted in a manner that fragments at least a portion of the intermetallic phase structure to further refine a consolidated microstructure of the hulk Al-RE alloy body.

Another aspect of the present invention provides a bulk Al-RE alloy body (product) made in the manner described above to have highly refined and beneficial microstructural features that provide excellent mechanical properties over a wide temperature range. The thermal stability of the produced microstructures provides for excellent high-temperature (>0.5 T melting) mechanical performance. The combination of good processability (i.e., easy consolidation or deformation at low temperature and or stresses/pressures) combined with excellent mechanical properties without the need for post heat treatments makes these Al-RE alloys consolidated as described above suitable for numerous engineering applications.

These and other objects and advantage associated with practice of aspects of the present invention will become readily apparent from the following drawings taken with the detailed description.

DETAILED DESCRIPTION OF THE INVENTION

Figure 1A:
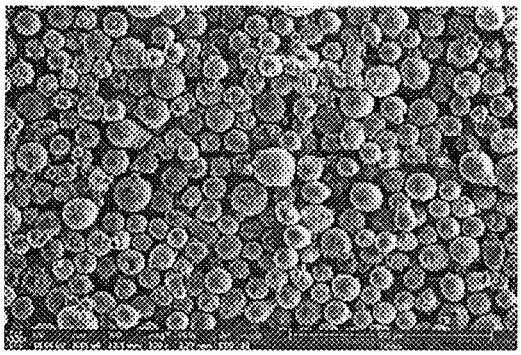
FIG. 1*a* is a SEM image of as-atomized Al-8Ce-10Mg powder produced by close-coupled gas atomization (horizontal scale bar is 500 μm).

Practice of certain aspects of the present invention involve production of a bulk Al-RE (RE=rare earth element) alloy body (product) using cast billets/ingots or rapidly solidified Al-RE precursor particulates that have beneficial rapid solidification-refined microstructural refinements that can be further refined by a subsequent consolidation step. A bulk Al-RE body so produced exhibits excellent mechanical properties over a wide temperature range such as up to and above 230° C.

Representative Al-RE alloys for use in practice of certain aspects of the present invention are described in detail in U.S. Pat. No. 9,963,770, the entire disclosure of which is incorporated herein by reference to this end. Such Al-RE alloys generally comprise about 5 to about 30 weight percent (%), preferably about 5 to about 20 weight %, and even more preferably about 6 to about 16 weight % RE (rare earth element) where RE is selected is selected from Ce, La, mischmetal, or any combination thereof, and balance aluminum (Al). These Al-RE alloys can optionally include Si, Fe, Mg, Cu, Ni, Mn, Zn and/or other alloying elements as described in above-mentioned U.S. Pat. No. 9,963,770.

The Al-RE alloys are formulated to include a relatively high weight percentage of a strengthening intermetallic $A_{11}RE_3$ phase in amounts from about 5 to about 30 weight % of individual particles where RE is defined above. The strengthening intermetallic $Al_{11}RE_3$ phase is characterized by being present in a relatively high phase fraction and by having closely spaced, fine lath microstructural features and/or rod microstructural features as well as fine lath spacing. These thermally stable intermetallic $Al_{11}RE_3$ phase survives the thermo-mechanical processing although its phase structure is further refined in the Al-rich matrix as described below.

High Cooling Rate Solidification:

To achieve high cooling rates rapid of the molten Al-RE alloy of $10^2$-$10^{6\circ}$ C./second during solidification, practice of certain aspects of the present invention involve use of rapidly solidified Al-RE particulates as feedstock for subsequent consolidation processing.

As mentioned above, practice of aspects of the present invention may include an initial step the rapid solidification processing of a selected molten Al-RE alloy. Representative of suitable rapid solidification processing techniques include, but are not limited to, various atomization techniques where a stream of molten Al-RE alloy is atomized to form spherical- or irregular-shaped particles and various melt spinning techniques where a stream of molten Al-RE alloy is discharged onto a rotating wheel (e.g., Cu) and ejected as a rapidly solidified ribbon that is then pulverized to form flake-shaped particles. These rapid solidification processes can achieve a cooling rate of the molten particles of at least $10^{2\circ}$ C. per second or more, such as $10^{4\circ}$ C. per second, or $10^{5\circ}$ C. per second, or more. It is apparent that the rapidly solidified particulates can be produced during rapid solidification processing (by atomization) or after rapid solidification processing (by melt spinning followed by pulverizing)

Regardless, the particulates subjected to rapid solidification processing are characterized by having an individual particle microstructure including the strengthening intermetallic $Al_{11}RE_3$ phase distributed in an aluminum-rich matrix. Importantly, the strengthening intermetallic $Al_{11}RE_3$ phase is characterized by having a "rapid solidification-refined" phase structure, such as for example, at least one of rods, dendrites, lath features, and cell wall thickness in a cellular microstructure (where Ce-containing intermetallic layers; i.e. cell walls, surround primary aluminum grains), which are highly refined compared to those of the same alloy as-sand cast alloy. The rapid solidification-refined phase structure includes at least one of a sub-micron (i.e. less than 1000 nm) sub-micron average rod dimension, average lath dimension, sub-micron average lath spacing dimension, and average cell wall thickness as defined above.

A subsequent step in practice of certain aspects of the present invention involves consolidating the particulates themselves or consolidating a precursor body, such as compact with or without a fugitive binder, made of the particulates. Consolidation is conducted by thermo-mechanical processing in a manner that breaks-up (fragments) at least a portion of the existing intermetallic phase structure (the existing laths and rods of the strengthening intermetallic $A_{11}RE_3$ phase) so as to further refine the consolidated microstructure of the bulk Al-RE alloy body. The existing intermetallic phase structure of laths and rods are further refined by fragmentation during the consolidation step to form more particle-like lath and rod fragments in the consolidated microstructure. These lath and/or rod fragments have a more individual, isolated particle-like morphology (FIG. 2) in the consolidated microstructure and also have even a smaller sub-micron dimensional scale as a result of their plastic deformation and fragmentation at elevated temperature during thermo-mechanical processing. Consolidation can achieve a highly refined intermetallic phase structure having at least one of individual particle-like lath fragments and particle-like rod fragments with an average dimension (length, width, thickness and/or diameter) in the range of 50 nm to 500 nm.

Consolidation can be conducted by an appropriate technique including, but not limited to, extrusion, sinter-forging, hot isostatic pressing, cold spray deposition, high-velocity oxygen-fuel spray deposition and others to produce a densified consolidated Al-RE alloy body. Spray deposition of the powder particles onto a substrate or a part utilizes a high particle temperature and/or high carrier gas velocity to deform the powder particles during deposition to form a coating with >95% density. The different thermo-mechanical processing techniques can utilize varying amounts of thermal and/or mechanical energy to produce a highly dense consolidated body with a highly refined microstructure. The plastic deformation and fragmentation of these strengthening intermetallic phase features during consolidation combined with their relatively smaller refined sizes, lead to exceptional mechanical performance including high tensile strengths and good ductility. Moreover, the thermal stability of the microstructures provides for excellent high-temperature (>0.5 $T_{melting}$) mechanical performance. The combination of good processability (i.e., easy consolidation at low temperature and or stresses/pressures) combined with excellent mechanical properties without the need for post heat treatments makes these Al-RE alloys consolidated from precursor particulates suitable for numerous engineering applications.

The following Examples are offered for purposes of illustration and not limitation to describe embodiments of this aspect of the present invention in more detail.

EXAMPLE 1

High Cooling Rate

Atomized powder comprising Al-8% Ce-10% Mg alloy powder (% is weight %) (+45/−106 μm particle size distribution) was synthesized by DOE Ames Laboratory using a close-coupled, high pressure gas atomization system of the type described in U.S. Pat. Nos. 5,372,629; 5,589,199, and 5,811,187, the entire disclosures of which are incorporated herein by reference.

For the atomized powder synthesized by the DOE Ames Laboratory, the gas atomization system includes a melting section including a cold wall, induction copper crucible and trumpet-bell pour tube as described and shown in Otaigbe, J., McAvoy, J., Anderson, I. E., Ting, J., Mi, J., and Terpstra, R. L., "Atomizing Apparatus for Making Polymer and Metal Powders and Whiskers"; in U.S. Pat. Nos. 6,358,466; 6,142,382; 6,425,504 and 6,533,563; and in I. E. Anderson, D. Byrd, and J. L Meyer, "Highly Tuned Gas Atomization for Controlled Preparation of Coarse Powder," MATWER, vol. 41, no. 7(2010), pp. 504-512, the entire disclosures of all of which are incorporated herein by reference. A close-coupled gas atomization nozzle was positioned just beneath the crucible in a drop tube chamber, the nozzle being described and shown in FIG. 2 of U.S. Pat. No. 5,125,574, the disclosure of which is incorporated herein by reference.

The drop tube chamber included a reactive gas zone disposed downstream (below) the gas atomization nozzle in the chamber as described and shown in U.S. Pat. Nos. 5,372,629; 5,589,199, and 5,811,187. The reactive gas zone was generated by a ring of gas injection nozzles connected to a source of high purity argon plus 800 ppm oxygen. As the atomized solidified particles passed through the reactive gas zone, a nano-scale passivation oxide layer was formed on the particle exterior surfaces to render them environmentally stable during subsequent processing steps and provide a particle surface oxygen content of less than 300 ppm.

The powder was produced by melting Al-8% Ce-10% Mg ingot to a superheat of 300 degrees C. in an induction heated alumina ($Al_2O_3$) crucible and exited the crucible from the pour tube. The crucible and pour tube were located in melting and atomizing chambers, both being evacuated initially and backfilled with argon before melt atomization began.

The melt exiting the pour tube was immediately impinged by the atomization gas jets from a gas atomizing nozzle of the close-coupled type as described in above-mentioned U.S. Pat. No. 5,125,574 to produce a high rapid cooling rate. The gas atomizing nozzle had discrete circular gas jet orifices of 0.125 inch diameter. The atomization gas was high purity (HP) argon supplied at high pressure (e.g. 300 psi). The partially or fully solidified atomized particles drop down the drop tube chamber and pass through the downstream reaction zone to produce the nano-scale oxide layer on the atomized powders in a particle collection chamber. The atomized particles then were sieved to provide a particle size classification of +45/−106 μm (i.e. particle size distribution of greater than 45 μm diameter and less than 106 μm diameter).

Figure 1B:
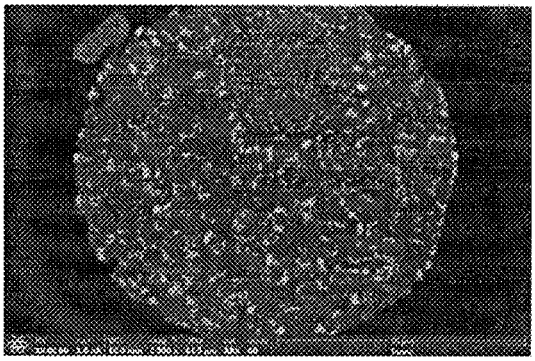
FIG. 1*b* is a SEM image of the cross-sectional microstructure of the as-atomized Al-8Ce-10Mg alloy powder (horizontal scale bar is 30 μm).

FIG. 1(*a*) is an SEM image of representative as-atomized Al-8Ce-10Mg alloy powders before sieving and classification showing a typical as-atomized particle size distribution. FIG. 1(*b*) shows an Al-rich matrix (darker phase) containing strengthening intermetallic $Al_{11}Ce_3$ phase (white phase). FIG. 1(*b*) shows an example of the small-sub-micron dimensional scale of the phase structure of the strengthening intermetallic $Al_{11}Ce_3$ phase (white phase) in the Al-rich matrix (darker phase) that is present throughout the as-atomized particle microstructure. A metastable Ce-containing intermetallic phase (e.g. tau phase) sometimes may be present but usually in minimal amount in the microstructure. The intermetallic second-phase ($Al_{11}Ce_3$) includes a phase structure having sub-micron scale rod, lath, and lath spacing, which is dramatically smaller than seen in the sand cast microstructures of the same alloy as-sand cast. The Ames Lab atomized powder was sieved and classified into different size fractions for different consolidation experiments. Approximately 20 g of the +45/−106 μm powder was placed in a Cu can to achieve tap density. The Cu can, which was 1.1 inches in outside diameter, was sealed under vacuum and then extruded through a 0.5 inch die (reduction in area ratio=5) at T=450° C. Three (3) extruded samples were made and tested.

Figure 2:
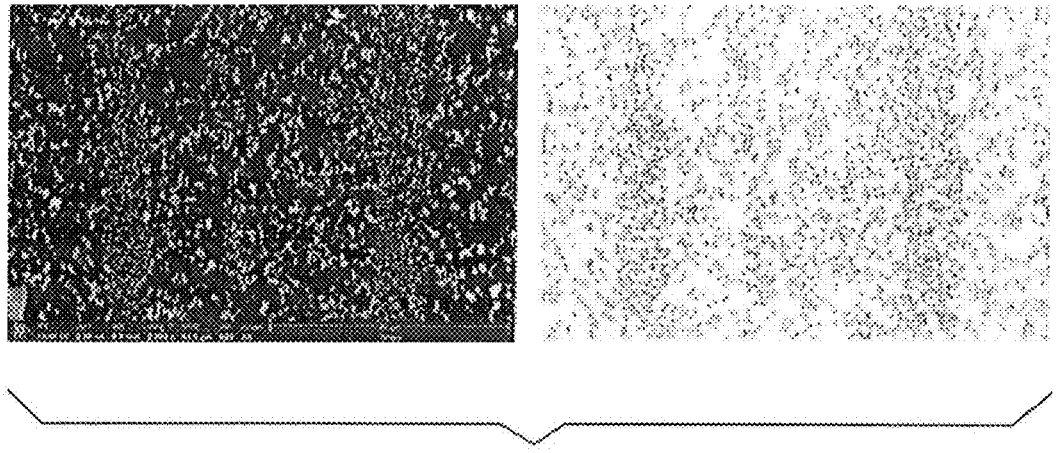
FIG. 2 includes respective back scattered electron and secondary electron SEM images (5000×) of an Al-8Ce-10Mg body extruded at 450° C. The extrusion direction is the vertical direction in FIG. 2.
Figure 3:
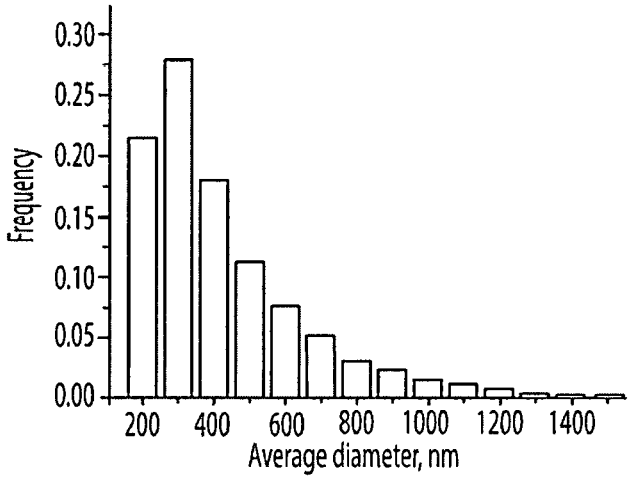
FIG. 3 shows a quantitative particle analysis of the average diameter of intermetallic strengthening particles present in that as-extruded Al-8Ce-10Mg body.

The microstructure along the extrusion direction, FIG. 2 (backscattered SEM images), shows a high density of small (sub-micron scale) individual intermetallic $Al_{11}Ce_3$ particle-like fragments that are surrounded by the Al-rich matrix as a result of extrusion forces breaking-up (fragmenting) the existing intermetallic lath and/or rod phase structure. The individual particle-like fragments are isolated and island-like; i.e. not interconnected. Quantitative image analysis of the microstructures of the extruded samples, FIG. 3, reveals that the average particle size (reported as particle diameters) of the intermetallic particle-like fragments ($Al_{11}Ce_3$) was about 375 nm. A small fraction of the larger intermetallic phase structures may also be seen in SEM images, which were preexisting in the as-atomized powders.

Figure 4:
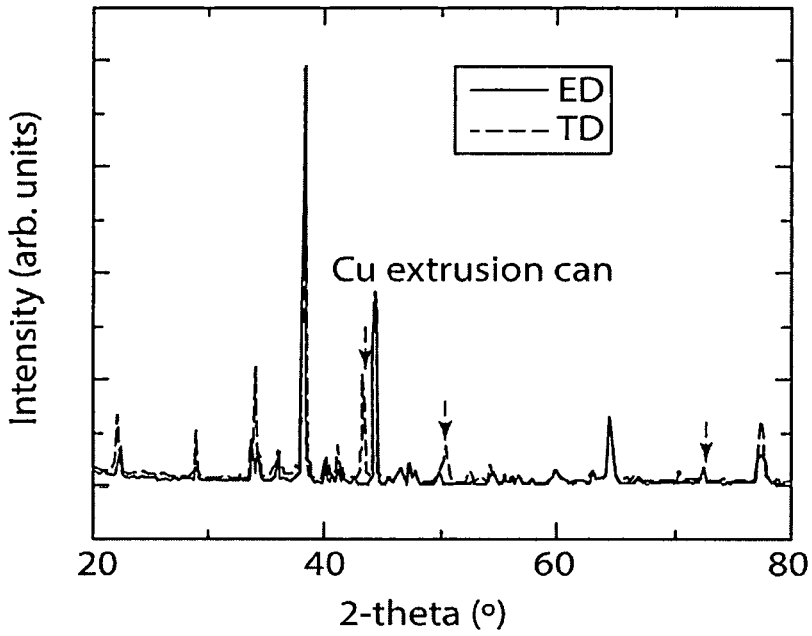
FIG. 4 is an XRD pattern of an Al-8Ce-10Mg body extruded at 450° C. in the extrusion direction (ED) and transverse direction (TD), which is similar to an XRD pattern (not shown) obtained from as-atomized powder particles (+45/−150 μm) of the same alloy. This suggests that there was no significant texturing after extrusion.

X-ray diffraction (XRD) of the extruded samples revealed that the patterns from samples cut parallel to the extrusion direction (ED) and normal to it, transverse direction (TD), exhibit very similar phase fractions (Al-fcc+$Al_{11}Ce_3$) and similar relative peak intensities, FIG. 4. This suggests that the extrusion process did not lead to a significant amount of texture development in the consolidated microstructure.

Figure 5:
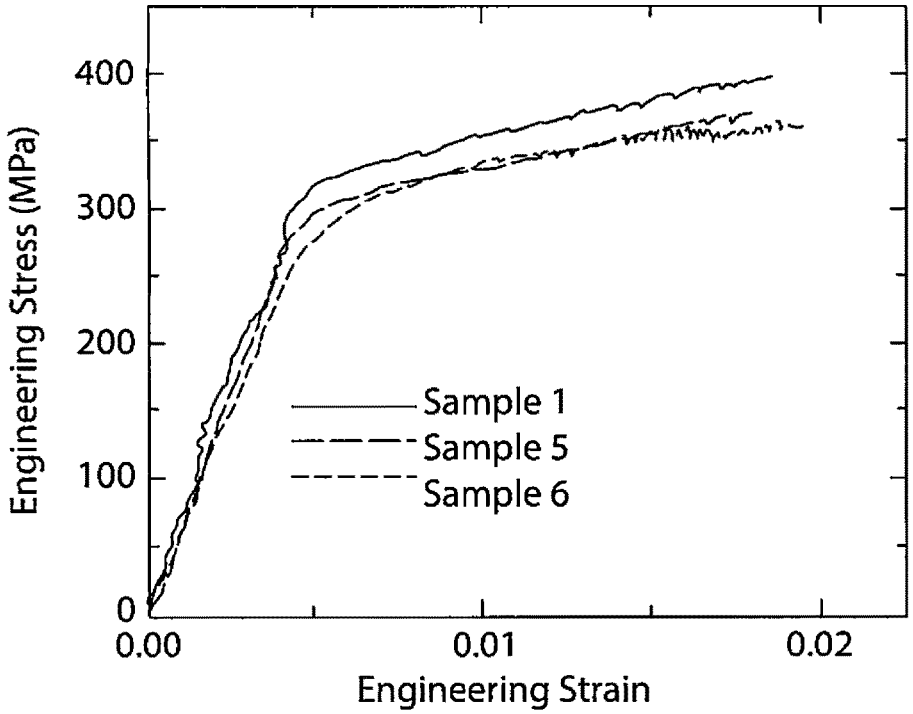
FIG. 5 shows quasi-static (strain rate=$1\times10^{-4}$ $s^{-1}$) uniaxial tension test curves of three extruded samples of the Al-8Ce-10Mg powder extruded at 450 degrees C. with a reduction in area ratio (extrusion ratio)=5.

To characterize the mechanical properties of the samples, mini-dogbone shaped samples were electrodischarge machine (EDM) cut from the extruded samples. The samples were EDM cut along the extrusion direction. The samples had about 3 mm gage width by about 6 mm gage length by about 0.6 mm thickness and were loaded in quasi-static strain rate=$1\times10^{-4}$ $s^{-1}$ uniaxial tension (Zwick tensile test machine MD142). The strain during loading was measured at room temperature by a non-contact laser extensometer. FIG. 4 shows the stress-strain curves for three (3) samples. Referring to FIG. 5, the samples demonstrated high yield stresses (YS>300 MPa) and ultimate tensile stresses (UTS>370 MPa such as 370-400 MPa), which are consistent with the highly refined microstructure. The room temperature mechanical properties can be further improved with higher extrusion ratios and/or lower extrusion temperatures.

Another batch of gas atomized Al-8Ce-10Mg was purchased from a commercial vendor and classified into a size fraction of 150 to 300 microns. As described above, the classified commercial Al-8Ce-10Mg powder was placed in a Cu can to achieve tap density. The Cu can, which was 1.1 inches in outside diameter, was sealed under vacuum and then extruded through a ⅜ inch die to provide a reduction in area ratio=9 at different T's=300, 350 and 450° C. The extruded samples were subjected to uniaxial tensile testing as described above.

Figure 5A:
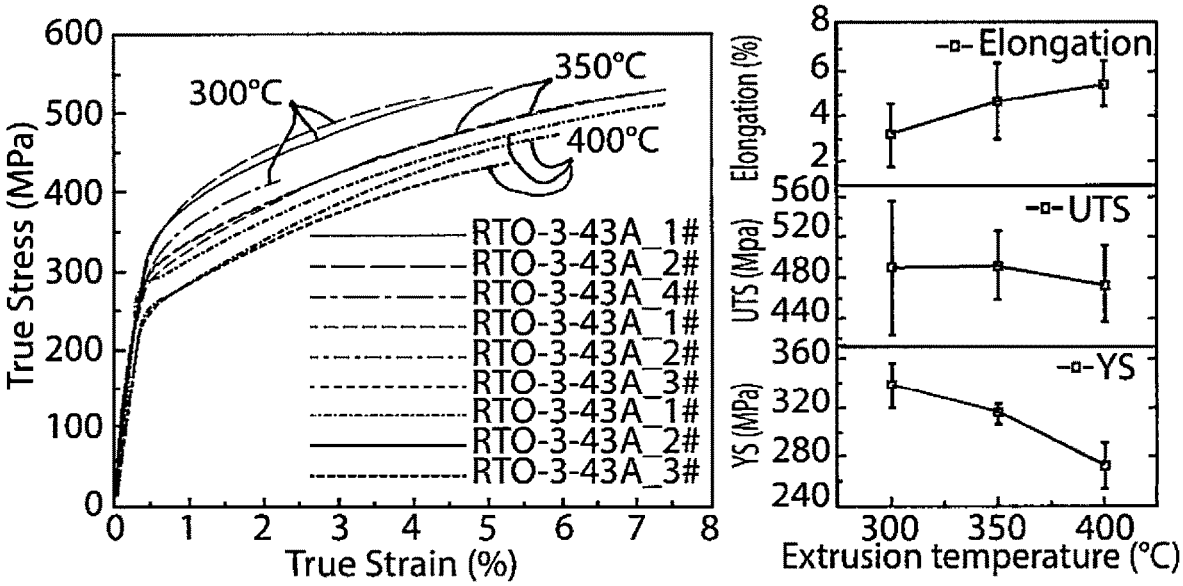
FIG. 5A shows uniaxial tension test curves (left hand graph) at strain rate=$1\times10^{-4}$ $s^{-1}$ of extruded samples of the Al-8Ce-10Mg powder produced by gas atomization by a commercial vendor for samples extruded at different temperatures as indicated on the left hand graph at a an reduction in area ratio=9, and shows average mechanical properties (measured at room temperature) in dependence on extrusion temperature (right hand graph).

FIG. 5A shows a graph (left hand view graph) of the room temperature mechanical properties produced by the different extrusion temperatures at a reduction ratio of 9. FIG. 5A shows (right hand graph) a summary of the average mechanical properties as they depend on extrusion temperatures. The samples demonstrated high yield stresses (YS) and ultimate tensile stress (UTS) as described above, and increased ductility (>5 total %), which are consistent with the highly refined microstructure.

EXAMPLE 2

Atomized powder comprising Al-8% Ce-10% Mg alloy powder (% is weight %) (+45/−150 μm particle size) was synthesized by close-coupled gas atomization as described above.

The atomized powder was sieved and classified into different size fractions for different consolidation experiments. In this trial, approximately 20 g of the +45/−150 μm powder was placed in a Cu can to achieve tap density. The Cu can, which was 1.1 inches in outside diameter, was sealed under vacuum and then initially extruded through a ⅜ inch die at T=250° C. Then, after 0.3 inch of punch travel, the temperature was increased to 260° C. degrees and extrusion stopped. Then, the temperature was increased to 275° C. after an additional 0.15 inch of punch travel all the way to completion of extrusion with a total of 1.4 inches punch travel.

A piece was cut off the extruded rod and polished for hardness evaluation. Several Vicker's hardness testing of the piece cut from the extruded rod indicated an average Vicker's hardness of 174.1+/−1.4. (Vicker's hardness testing at 10 kg load and 100 kg max load using a 1/16 inch indenter).

EXAMPLE 3

Atomized powder comprising Al-8% Ce-10% Mg alloy powder (% is weight %) (+45/−150 μm particle size) was synthesized by close-coupled gas atomization as described above.

The atomized powder was sieved and classified into different size fractions for different consolidation experiments. In this trial, approximately 20 g of the +45/−150 μm powder was placed in a Cu can to achieve tap density. The Cu can, which was 1.1 inches in outside diameter, was sealed under vacuum and then extruded through a ⅜ inch die at T=300° C.

A piece was cut off the extruded rod and polished for hardness evaluation. Vicker's hardness testing of the piece cut from the extruded rod indicated an average Vicker's hardness of 166.41+/−3.4. (Vicker's hardness testing at 10 kg load and 100 kg max load using a 1/16 inch indenter).

EXAMPLE 4

Atomized powder comprising Al-8% Ce-10% Mg alloy powder (% is weight %) from Example 3 but sieved to 150-300 micron average particle size was used in this trail. An amount of the powder was funneled into a rubber tube (1 inch in diameter) and clamped at the open end using a binder clip.

Samples in the rubber tubes were cold isostatically pressed at 38 ksi at room temperature and other samples were pressed at 50 ksi at room temperature. After removal from the rubber tubes, the CIP'ed powder bodies were generally cylindrical in shape.

The CIP'ed bodies then were extruded through a ⅜ inch die at T=300° C. after the die and sample was preheated to 300 degrees F. for 10 minutes. A piece of the extruded rod was cut off and polished.

Vicker's hardness testing of the piece cut from an extruded rods and polished indicated an average Vicker's hardness of 163.5+/−1.0. (Vicker's hardness testing at 10 kg load and 100 kg max load using a 1/16 inch indenter).

The Examples set forth above demonstrate that the intermetallic $Al_{11}Ce_3$ phase survives the thermo-mechanical (e.g. extrusion) processing over processing temperatures of 250 to 450° C. during which its phase structure is refined as described. Although elevated extrusion temperatures were used in the Examples set forth above, certain aspects of the invention envision using commercial extrusion equipment that can exert much higher extrusion force to extrude the Al-8Ce-10Mg alloy powder bodies at or near room temperature and above.

Slower Cooling Rate Solidification:

To achieve relatively slower cooling rates of the molten Al-RE alloy of <100° C./second during solidification, practice of certain aspects of the present invention involve solidifying the molten Al-RE alloy by pouring or otherwise introducing the molten alloy into a sand mold, permanent mold, die casting mold, or other mold and solidifying the alloy at a cooling rate <100° C./second in the form of a cast billet, cast ingot or other cast monolithic (bulk) body. U.S. Pat. No. 9,963,770 describes casting of Al-RE alloys by various casting techniques, the disclosure of this patent being incorporated herein by reference to this end.

The solidified Al-RE alloy cast billet, cast ingot or cast body then is subjected to thermo-mechanical processing in a manner to refine microstructural features of the solidified alloy in a manner that provides excellent mechanical properties over a wide temperature range. Certain aspects of the present invention involve thermo-mechanically plastically deforming the solidified alloy billet, ingot, or body at elevated temperature to fragment and thus refine the microstructural intermetallic phase features such as to reduce intermetallic phase size and/or refine (reduce) the grain size of the Al-rich matrix. The thermo-mechanical processing technique can be selected from those techniques described above as well as others that achieve the desired refinement results.

EXAMPLE 5

Slower Cooling Rate

Figure 6:
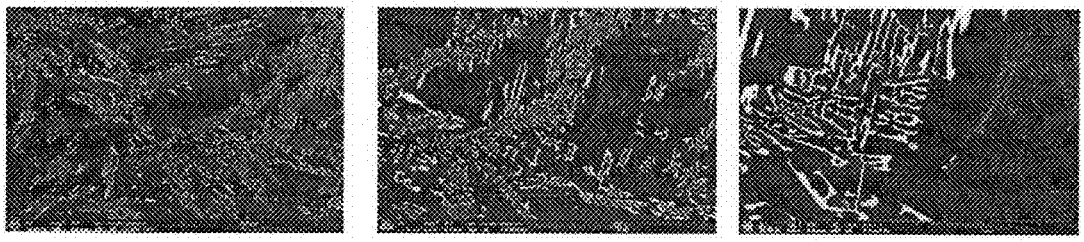
FIG. 6 shows SEM's of as-cast microstructure of a Al—Ce—Mg alloy cast into 1" diameter permanent mold at different magnifications.

The molten Al-8Ce-10Mg alloy was poured and solidified in air in a one-inch diameter unheated, permanent steel mold. FIG. 6 shows the solidified Al—Ce—Mg alloy billet after removal from the permanent mold.

Figure 7:
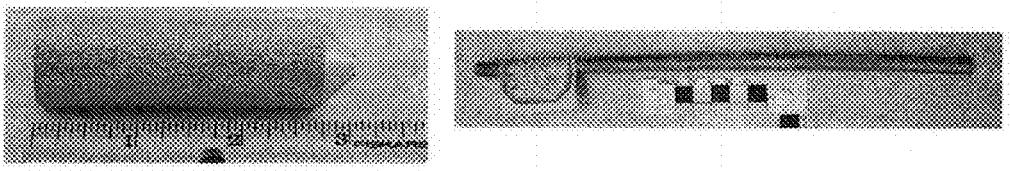
FIG. 7 shows a photograph of the cast Al—Ce—Mg billet before (left) and after extrusion at 300° C. (right).
Figure 8:
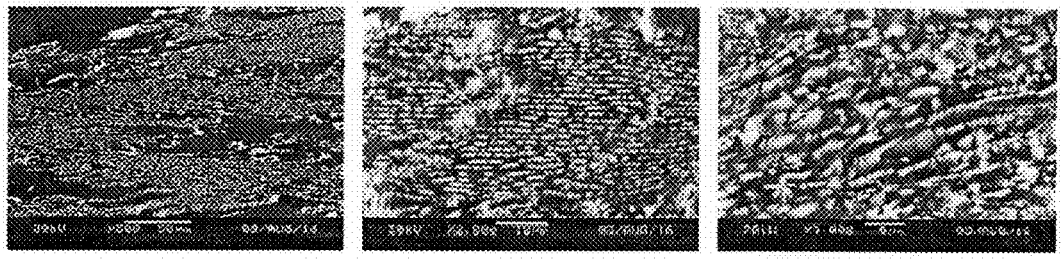
FIG. 8 shows SEM's of the microstructure of an Al—Ce—Mg rod after the extrusion where the views are taken in longitudinal direction (parallel to extrusion direction) at different magnifications.

The billet was then extruded. FIG. 7 shows the Al—Ce—Mg alloy after uniaxial extrusion in air at T=300° C. with a ⅜ inch die. while FIG. 8 shows an SEM image along transverse direction (normal to extrusion direction) of the extruded alloy rod showing a refined microstructure having a high density of small (sub-micron scale) individual) intermetallic $Al_{11}Ce_3$ particle-like fragments that are surrounded by the Al-rich matrix as a result of extrusion forces breaking-up (fragmenting) the existing intermetallic lath and/or rod phase structure. At least a portion of the individual particle-like fragments are isolated and island-like.

The uniaxial tensile properties of the Al-8Ce-10Mg alloy before and after extrusion were as follows:

As-cast alloy exhibited a yield stress of 30.0 ksi (0.05% offset) as compared to 48.9 ksi for the extruded alloy rod at room temperature.

As-cast Al-8Ce-10Mg alloy exhibited a tensile stress of 34.0 ksi as compared to 51.4 ksi for the extruded alloy rod at room temperature.

As-cast Al-8Ce-10Mg alloy exhibited a total elongation of 2% as compared to 6.6% for the extruded alloy rod at room temperature.

Although aspects of the present invention have been described and shown with respect to certain illustrative embodiments, those skilled in the art will appreciate that the invention is not limited to these aspects and that changes and modifications can be made therein within the scope of the invention as set forth in the appended claims.

We claim:

1. A method of making a bulk Al-RE alloy body where RE is Ce, La, mischmetal, or any combination thereof, comprising:

a) solidifying a molten Al-RE alloy where RE=Ce, La, mischmetal, or any combination thereof, wherein the alloy has a composition consisting essentially of Al, RE, and at least one of Mg, Cu, Ni, Mn, and/or Zn to form an as-solidified Al-RE alloy with an Al-rich matrix, and b) thermo-mechanical processing the as-solidified Al-RE alloy directly in an as-cast condition in a manner that refines at least a portion of a microstructural feature of the solidified Al-RE alloy, wherein the refined microstructural feature comprises at least one of reduced intermetallic phase size and reduced matrix grain size.

2. The method of claim 1 wherein the molten Al-RE alloy is solidified at a cooling rate less than 100 degrees C. per second as a cast billet, cast ingot, or other monolithic cast body.

3. The method of claim 2 wherein the cast billet, cast ingot, or monolithic cast body in the as-cast condition is directly subjected to thermo-mechanical processing.

4. The method of claim 1 wherein the molten Al-RE alloy is solidified by breaking up a molten stream of the alloy.

5. The method of claim 4 wherein the molten Al-RE alloy is solidified at a cooling rate of at least $10^{2\circ}$ C. per second and above.

6. The method of claim 1 wherein the molten Al-RE alloy is solidified in a mold.

7. The method of claim 6 wherein the mold comprises at least one of sand mold, permanent mold, and die casting mold.

8. The method of claim 1 wherein solidifying is by direct chill casting.

9. The method of claim 1 wherein thermo-mechanical processing of the as-solidified Al-Re alloy directly in the as-cast condition is conducted by at least one of extrusion, forging, sinter-forging, rolling, isostatic pressing, spray deposition, and high-velocity oxygen-fuel spray deposition.

* * * * *